US006298842B1

(12) United States Patent
Sims

(10) Patent No.: US 6,298,842 B1
(45) Date of Patent: Oct. 9, 2001

(54) ARCHERY BOW ACCESSORIES WITH BOW VIBRATION DECAY PATTERN MODIFIERS FOR IMPROVING ACCURACY

(76) Inventor: Steven C. Sims, 450 Enterprise Rd., Shelton, WA (US) 98054

( * ) Notice: Subject to any disclaimer, the term of this patent is extended or adjusted under 35 U.S.C. 154(b) by 0 days.

(21) Appl. No.: 09/478,921

(22) Filed: Jan. 6, 2000

Related U.S. Application Data

(60) Provisional application No. 60/115,007, filed on Jan. 6, 1999.

(51) Int. Cl.[7] ..... F41B 5/20
(52) U.S. Cl. ..... 124/89; 267/136
(58) Field of Search ..... 124/23.1, 86, 89; 188/268; 267/136

(56) References Cited

U.S. PATENT DOCUMENTS 3,196,860 * 7/1965 Hoyt ..... 124/89
3,757,761 * 9/1973 Izuta ..... 124/89 X
4,570,608 * 2/1986 Masterfield ..... 124/89
4,615,327 * 10/1986 Saunders ..... 124/89
5,362,046 11/1994 Sims .
5,595,168 * 1/1997 Martin ..... 124/89
5,720,267 * 2/1998 Walk ..... 124/23.1
5,937,843 * 8/1999 Troncoso ..... 124/89

* cited by examiner

*Primary Examiner*—John A. Ricci
(74) *Attorney, Agent, or Firm*—Richard D. Multer

(57) ABSTRACT

Devices for modifying the pattern of vibrations set up in a bow when an arrow is released. These devices have an integral head and stem and are fabricated from an elastomeric material. Versions suitable for attachment to bow with solid and split limbs are disclosed as are models designed for attachment to a bow stabilizer.

38 Claims, 6 Drawing Sheets

ARCHERY BOW ACCESSORIES WITH BOW VIBRATION DECAY PATTERN MODIFIERS FOR IMPROVING ACCURACY

This application claims priority from Provisional Application Ser. No. 60/115,007, filed Jan. 6, 1999.

TECHNICAL FIELD OF THE INVENTION

The present invention relates to archery bows, and more particularly, to novel, improved bows with accessories which improve accuracy by modifying the decay pattern of the vibrations set up in the bow when an arrow is released.

BACKGROUND OF THE INVENTION

The release of an arrow from even a modern bow sets up significant vibrations in the limbs of the bow, and these are in large part transmitted to the riser of the bow and from there to the archer's hand. The result is a significant adverse effect on accuracy.

A variety of stabilizers have been employed in an effort to reduce the adverse effect of this vibration on the accuracy of the bow. At best, such devices have proved to be of limited value.

SUMMARY OF THE INVENTION

There have now been invented and disclosed herein certain new and novel vibration decay pattern modifiers which significantly reduce the adverse effect on accuracy of the vibrations generated when an arrow is released. Different ones of these decay pattern modifiers are fixed to the limbs of the bow and/or to the end of the hydraulic stabilizer typically attached to the riser of a compound bow.

Decay pattern modifiers in accord with the principles of the present invention are fabricated from a soft visco-elastic polymer and have a mushroom-like configuration provided by a head and an integral stem. The head and stem of the decay pattern modifiers are so configured and dimensioned that: (1) the modifier can vibrate or oscillate toward and away from the longitudinal axis of the modifiers at any and all locations around the 360° circumference of the modifier, and (2) peripheral portions of the decay pattern modifier head can oscillate in directions generally parallel to the longitudinal modifier axis at any (and all) locations around the circumference of the decay pattern modifiers. Motions are also set up in the material of the damper. The combined result of these motions is a wiggle and jiggle which significantly alters the pattern of vibrations set up in the bow when an arrow is released, effectively minimizing the effect on accuracy of those vibrations Yet another, particularly important advantage of the present invention is that there is only a small, two foot per second (typical) loss in arrow velocity appurtenant to the use of decay pattern modifiers embodying its principles.

Another important attribute of the novel decay pattern modifiers disclosed herein is that they are light and small enough that they do not interfere with the normal drawing of the bow string and subsequent release of an arrow.

Other important objects, features, and advantages of the invention will be apparent to the reader from the foregoing and the appended claims and as the ensuing detailed description and discussion of the invention proceeds in conjunction with the accompanying drawing.

DETAILED DESCRIPTION OF THE INVENTION

Figure 1:
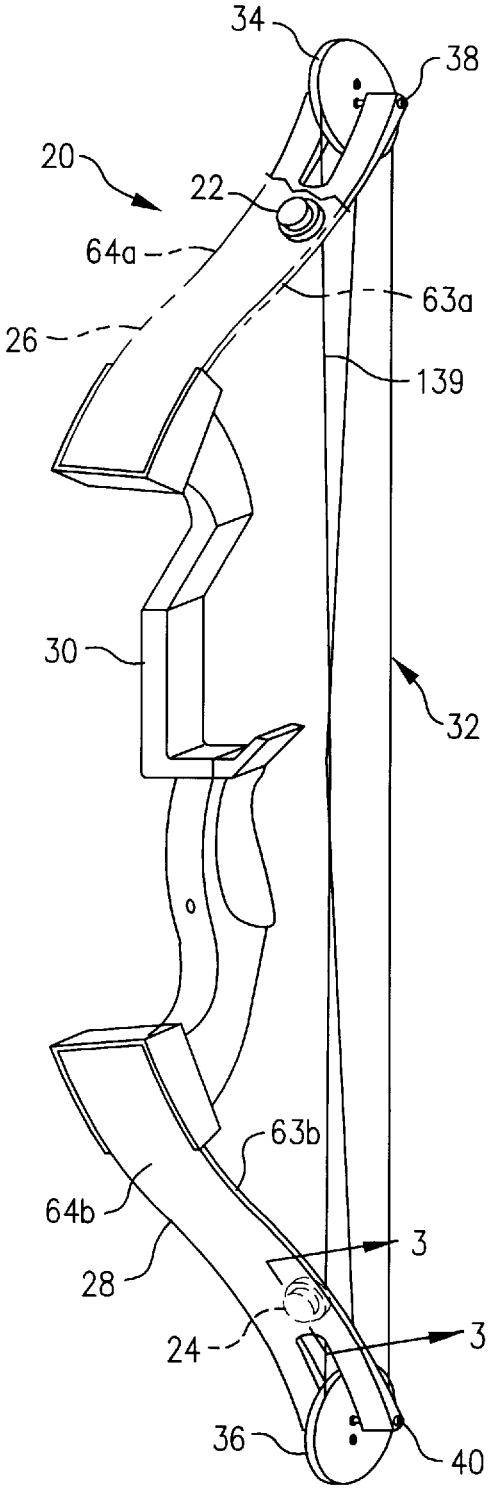
FIG. 1 is a pictorial view of a compound bow equipped with decay pattern modifiers constructed in accord with the principles of the present invention; components of the bow which are not relevant to an understanding of the present invention do not appear in FIG. 1; these include the bow sight and the often present, built-in quiver.

Referring now to the drawings, FIG. 1 depicts a compound bow 20 equipped with decay pattern modifier 22 and 24 in accord with the principles of the present invention. Bow 20 has flexible limbs 26 and 28 mounted to the opposite ends of a riser 30 and a bow string 32. The bow string is strung around cams 34 and 36 at the ends of limbs 26 and 28. The ends of the bow string are anchored to the shafts 38 and 40 which support cams 34 and 36 from the limbs 26 and 28 of bow 20.

Figure 2:
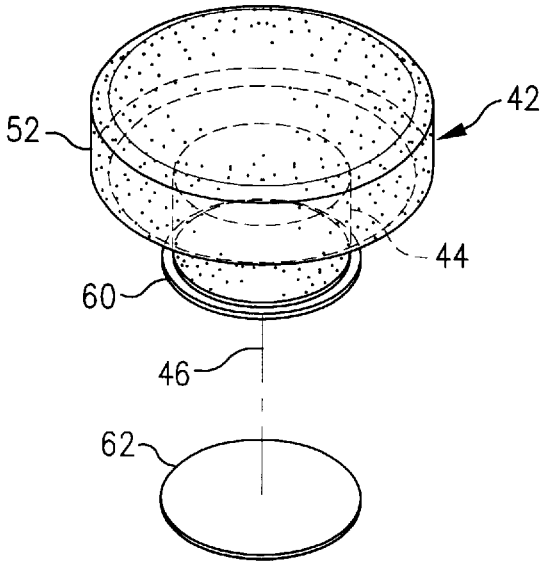
FIG. 2 is an exploded view, to an enlarged scale, of one of two identical decay pattern modifiers with which the bow of FIG. 1 is equipped.
Figure 3:
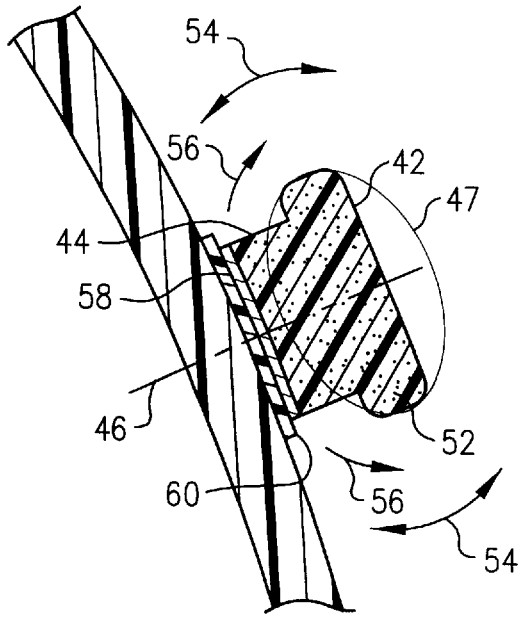
FIG. 3 is a fragmentary section through one limb of the FIG. 1 bow and the decay pattern modifier attached to that limb.

The two decay pattern modifiers 22 and 24 are duplicates; accordingly, only decay pattern modifier 24, shown in more detail in FIGS. 2 and 3, will be considered in detail herein.

Decay pattern modifier 24 has a mushroom-like configuration and a T-like cross-section defined by a cylindrical head 42 and an integral, also cylindrical stem 44. Decay pattern modifier 20 is fabricated from a soft, visco-elastic material; preferably, a visco-elastic material with a Shore A hardness in the range of three to 20. The ratio between the diameter of decay pattern modifier head 42 and the length of stem 44 is preferably kept between 1:1 and 5:1 for optimal effectiveness.

One suitable visco-elastic material is NAVCOM. NAVCOM is a soft, amorphous, rubber-like material which contains a mixture of chloroprene and butyl polymers and has the following physical properties (representative).

| Shore A hardness: 17–90 | | | | | |
|---|---|---|---|---|---|
| Environment | Shore A | Ultimate Elongation (Percent) | Tensile Strength (PSI) | Compression Set (Percent) | Specific Gravity |
| Oven aged | 7 | 1,075 | 373 | 6.01 | 1.014 |
| for | 12 | 900 | 643 | 7.3 | 1.025 |
| 70 hrs at | 20 | 835 | 1,069 | 6.9 | 1.063 |
| 212 ± 5° F. | 30 | 1,056 | 1,621 | 4.0 | 1.074 |
| | 40 | 326 | 1,453 | N/A | 1.185 |
| | 90 | 175 | 2,440 | N/A | 1.379 |
| | 7 | N/A | N/A | 56.3 | — |
| | 12 | — | — | 31.1 | — |
| | 20 | — | — | 30.8 | — |
| | 40 | — | — | 22.4 | — |
| | 90 | — | — | 18.6 | — |

| | |
|---|---|
| Resilience: | At room temperature - Medium |
| | At high temperature - Fairly high |
| Heat resistance | Good |
| Outdoor aging resistance: | Excellent |
| Low temp flexibility: | Good |
| Abrasion resistance: | Good |
| Flex life: | Good |
| Solvent resistance: | |
| Hydrocarbons- | Fair to good |
| Oxygenated- | Fair to good |
| Air permeability: | Low to moderate |
| Moisture resistance: | Fair |
| Useful operating temperature: | −40° to 250° F. |

The nominal dimensions of the exemplary illustrated decay pattern modifier are:

| | |
|---|---|
| Head 42: | |
| Diameter: | 1.44 in. |
| Width: | 0.38 in. |
| Stem 44: | |
| Diameter: | 0.76 in. |
| Length: | 0.25 in. |

The stem 44 of decay pattern modifier 24 can vibrate toward and away from the longitudinal axis 46 of the device at any and all directions around the 360° circumference of modifier as indicated by ellipse 47 in FIG. 3. At the same time, the peripheral edge portion 52 of head 42 can oscillate back and forth at any and all locations around the 360° circumference of the head in directions generally paralleling longitudinal axis 46 as indicated by arrows 54 and 56. There may also be otherwise directed movement of the modifier head and stem when and after an arrow is released as well as oscillations set up in the head and stem of the modifier. These oscillations and movements in total—herein referred to as "wiggle and jiggle"—produce the beneficial shift in vibration decay patterns realized by employing a vibration decay pattern modifier as just disclosed as well as other such accessories embodying the principles of the present invention including those embodiments disclosed hereafter in this specification and illustrated in the drawings. These unique patterns of oscillatory movement have been found to be highly effective in modifying the patterns of vibration set up in a bow when an arrow is released in a positive manner.

Figure 17:
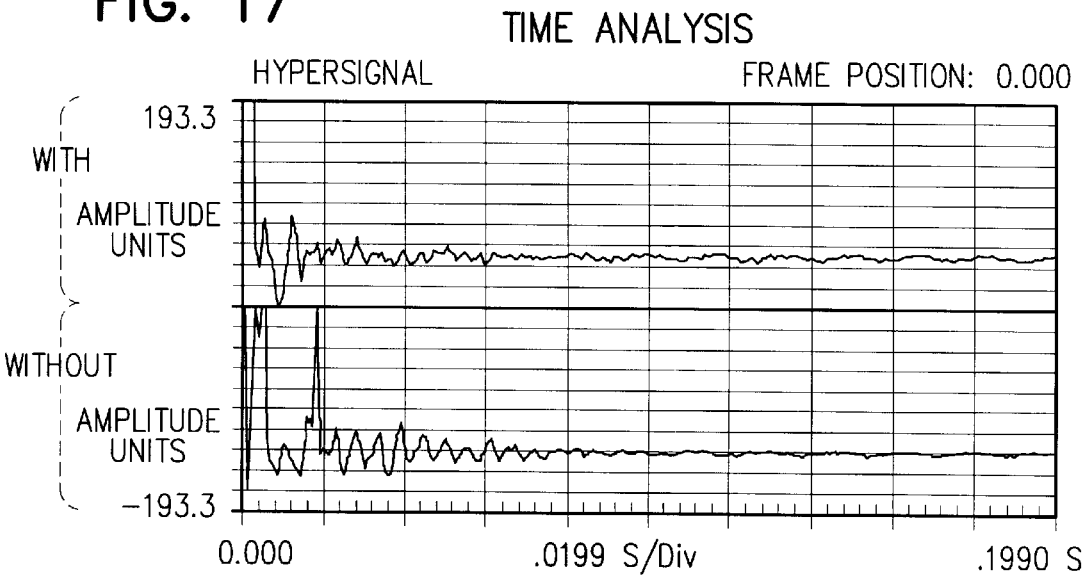
FIGS. 17 and 18 are graphs showing the significant effect beneficial alteration of bow vibration pattern that can be realized by employing decay pattern modifiers as illustrated in FIGS. 1–3.
Figure 18:
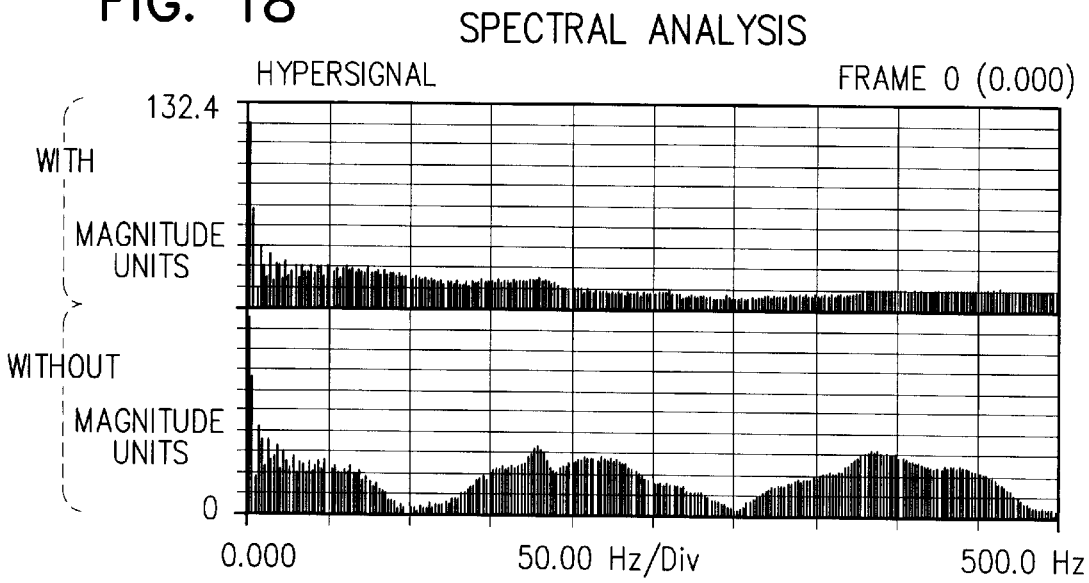

The dramatic shift in the decay pattern of the vibrations set up in a bow when an arrow is released effected by devices as just described is dramatic as is shown in FIGS. 17 and 18. FIG. 17 shows that there is a significant reduction in the amplitude of the vibrations beginning at time zero (time of arrow release). The spatial analyses of FIG. 18 shows a similar, significant reduction in both the primary frequencies of the vibrations set up in the bow when an arrow is released and in the harmonic frequencies of those vibrations.

As shown in FIGS. 2 and 3, the exposed end 58 of decay pattern modifier stem 44 is covered by a layer 60 of adhesive which is protected by a peel-off cover 62. This makes the attachment of the decay pattern modifier to the associated limb of bow 20 a task of the utmost simplicity. All that is required is to remove cover 62 and then press the decay pattern modifier onto the limb of the bow at the selected location therealong.

In this regard, the decay pattern modifiers 22 and 24 are preferably located near the outer ends of the two limbs 26 and 28 of bow 20 (FIG. 1). The placing of the decay pattern modifiers at these locations has been found to be the most effective in modifying the vibrations set up in bow 20 when an arrow is released in a positive manner.

It is also preferred that the decay pattern modifiers 22 and 24 be mounted on the inner sides (63*a* and 63*b*) of the bow limbs 26 and 28; i.e., on the sides of those limbs facing bow string 32. This keeps the decay pattern modifiers from being snagged as the bowman moves through brush or bushes, for example. The same, significant, worthwhile modification in the vibration decay pattern can nevertheless be obtained by mounting the decay pattern modifier on the outer sides 64*a* and 64*b* of the bow limbs. This arrangement is depicted in FIG. 4 which shows a decay pattern modifier 65 of the character described above mounted on the outer side 64*a* of bow limb 26.

Figure 4:
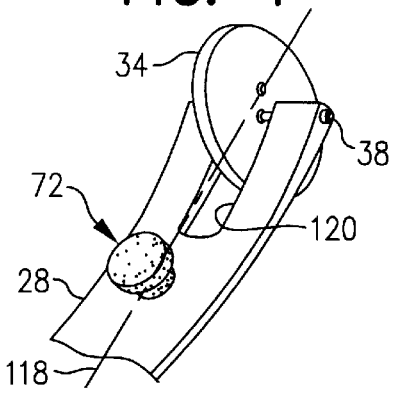
FIG. 4 shows an alternate location on the bow link for the decay pattern modifier.
Figure 6:
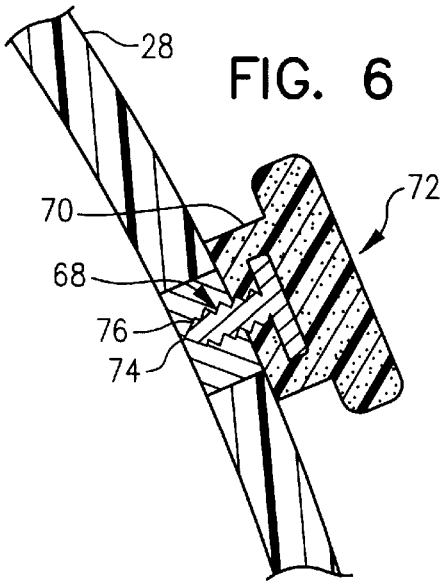
FIG. 6 is a section through the FIG. 5 decay pattern modifier.

FIGS. 4 and 6 of the drawings, to which reference is now made, depict an alternate arrangement for attaching a decay pattern modifier as described above to the limb of a bow; e.g., the limb 28 of bow 20. In this case, a threaded fastener 68 is embedded in the stem 70 of decay pattern modifier 72 with the threaded shank 74 of fastener 68 protruding from the stem. Shank 74 is screwed into an internally threaded fitting 76 mounted in the limb 28 of the bow as shown in FIG. 6. This securely attaches the decay pattern modifier to the limb of the bow.

Figure 5:
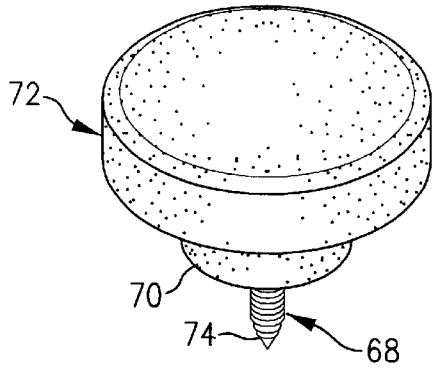
FIG. 5 shows a second decay pattern modifier with an alternate mechanism for attaching the decay pattern modifier to the limb of a bow.

In that exemplary embodiment of the invention illustrated in FIGS. 5 and 6, decay pattern modifier 72 is mounted in the preferred location; i.e., on the inner side 63*b* of limb 28. This is not required, however; and the decay pattern modifier could instead, if desired, be mounted on the outer side 64*b* of the limb.

Figure 7:
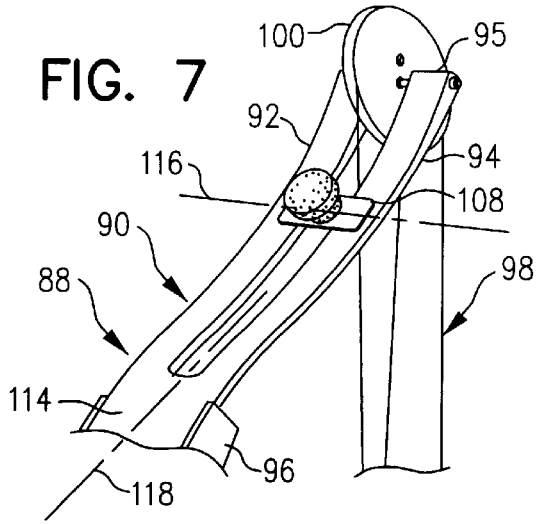
FIG. 7 is a fragmentary view of a second compound bow which is of the split limb type and which is equipped with decay pattern modifiers in accord with the principles of the present invention.

Referring still to the drawings, FIG. 7 depicts, in fragmentary form, a compound bow 88 of the split limb type. The illustrated limb 90 of this bow has two separate, parallel branches 92 and 94 which extend from the end 95 of limb 90 to a location just short of the riser 96 of the bow.

Like the bow 20 depicted in FIG. 1, bow 88 also includes a bow string 98 strung over cams at the ends of the bow's two limbs. One of these cams is shown in FIG. 7 and identified by reference character 100.

Figure 8:
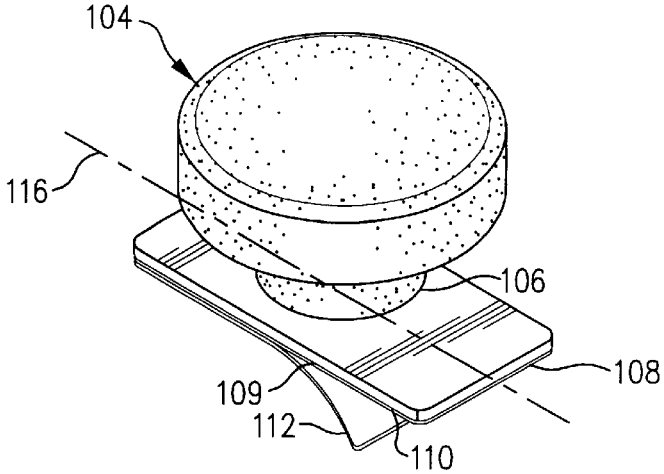
FIG. 8 is an enlarged and isometric view of a decay pattern modifier as shown in FIG. 7.

A decay pattern modifier specifically designed for a bow of the type just described is depicted in FIG. 8 and identified by reference character 104. This decay pattern modifier may be of the type discussed above and identified by reference character 24 in FIGS. 2 and 3. The stem 106 of decay pattern modifier 104 is fixed to a flat, elongated, generally rigid mount 108. The surface 109 of mount 108 opposite the decay pattern modifier is coated with a layer 110 of adhesive, the adhesive being covered by a peel away strip 112.

Decay pattern modifier 104 is mounted to the limb 90 of bow 88 (in this case on the outer side 114 of the limb for purposes of clarity only) by removing protective strip 112 from mounting plate 108 and then pressing the mounting plate onto limb 90 of the bow to fix it in place. The mounting plate 108 is oriented: (1) with its longitudinal axis 116 at right angles to the longitudinal axis 118 of limb 90, (2) with the mounting plate spanning the gap 120 between the two branches 92 and 94 of limb 90, and (3) with the mounting plate 108 centered on gap 120 to provide equal area contact between the plate and the branches 92 and 94 of the bow limb.

Figure 9:
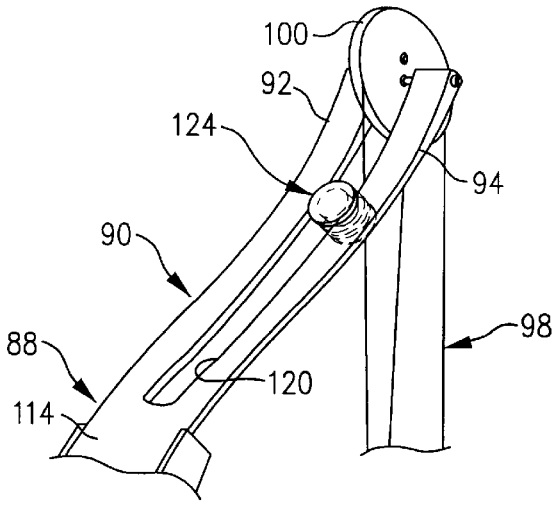
FIG. 9 is a view similar to FIG. 7 but showing an alternate form of decay pattern modifier designed for use with split limb bows.

An alternate arrangement for attaching a decay pattern modifier as disclosed herein to the limb of a split limb bow is illustrated in FIG. 9. The decay pattern modifier is shown in more detail and identified by reference character 124 in FIG. 10. The bow shown in FIG. 9 may duplicate the bow illustrated in FIG. 7. Therefore, the bow and its illustrated components have been identified by the same reference characters in both FIG. 7 and FIG. 9.

Decay pattern modifier 124 has an integral head 125 and stem 126 providing the same mushroom shape as the decay pattern modifier discussed above and the same patterns of movement as is suggested by ellipse 47 and arcs 54 and 56 in FIG. 3.

NAVCOM is the preferred material from which stabilizer-associated decay pattern modifier 124 is fabricated. The dimensions of decay pattern modifier 124 may essentially duplicate those of the previously described decay pattern modifiers:

Decay pattern modifier 124 promotes accuracy in much the same manner as limb-associated decay pattern modifiers 22 and 24. Specifically, when bow string 98 is released, vibrations which have an adverse effect on accuracy are unavoidably set in the bow and are transmitted from the stabilizer through the bow to the archer's hand despite stabilizer 140. Decay pattern modifier 124 alters the decay pattern of these vibrations in a manner which markedly reduces, if it does not entirely eliminate, the accuracy-reducing effect of those vibrations.

Figure 10:
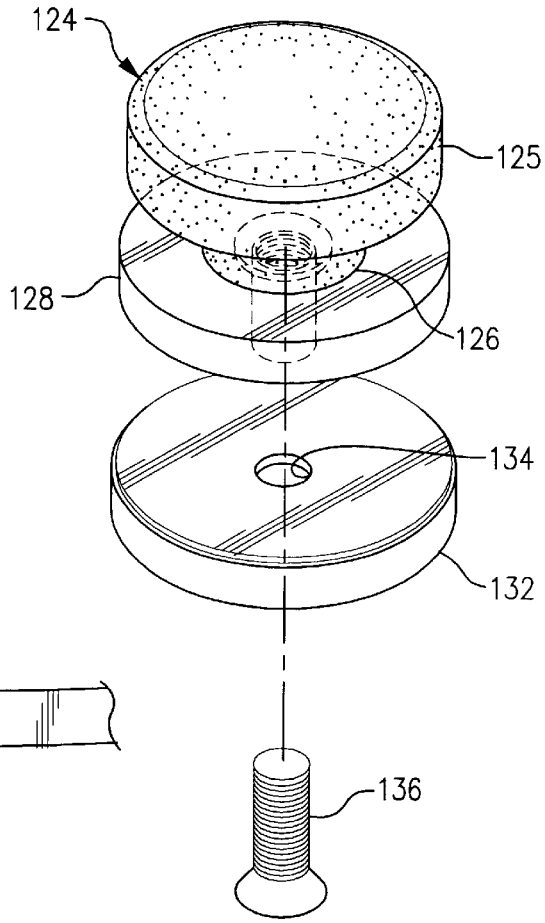
FIG. 10 is an exploded view of the decay pattern modifier depicted in FIG. 9.
Figure 11:
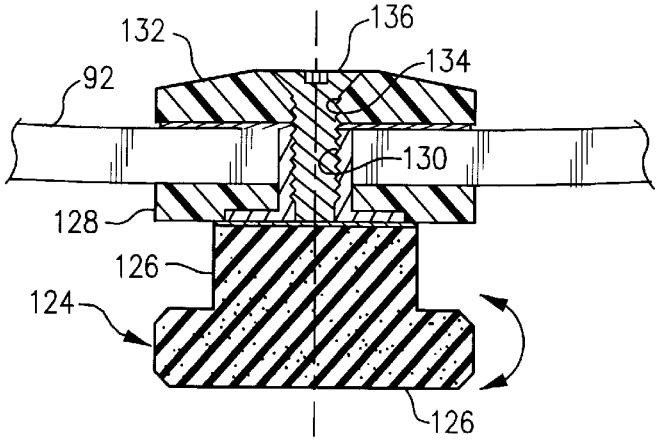
FIG. 11 is a longitudinal section through the decay pattern modifier of FIG. 10.

Referring now specifically to FIGS. 10 and 11, the stem 126 of decay pattern modifier 124 is fixed to a flat, circular, generally rigid mount 128, which has a centrally located, internally threaded aperture 130.

Employed with decay pattern modifier 124 are: (1) a flat, also rigid washer 132 with a central aperture 134, and (2) a machine screw 136. Decay pattern modifier 124 is mounted to the limb 90 of bow 88 by placing the decay pattern modifier on one side of limb 90 (again, the outer side 114 of the limb has been chosen, only for purposes of clarity).

Next, washer 132 is aligned with mount 128 on the opposite side of limb 90. Then, machine screw 136 is displaced through the aperture 134 in washer 132 and the gap 120 between split limb prongs 92 and 94 and threaded into mounting component aperture 130. This clamps split limb prongs 92 and 94 between the mounting component 128 and washer 132, securing decay pattern modifier 124 in place.

Figure 14:
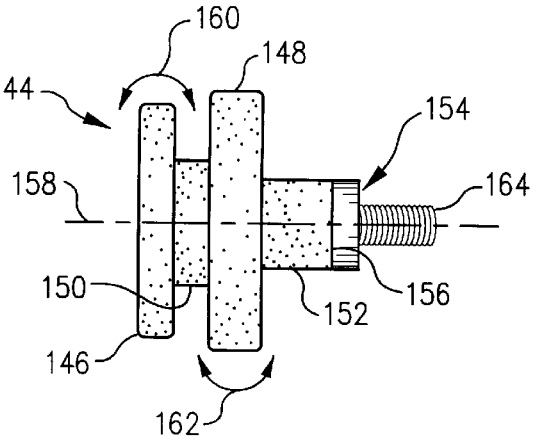
FIG. 14 is a side view of the FIG. 12 decay pattern modifier.

In those embodiments of the invention depicted in FIGS. 4, 7, and 9, the decay pattern modifier is also preferably located toward the outer end of the limb to which it is mounted for maximum effectiveness. Decay pattern modifiers mounted on the inside of a bow's limb (see FIGS. 1 and 9 as examples) are mounted far enough down the limbs of the bow from the outer ends of the limbs to which they are mounted that the modifiers will not be struck by the inner run 139 of bowstring 32 when an arrow is released. This insures that the rebounding run 139 of bowstring 32 in will not knock the decay pattern modifier off the bow when the arrow is released. Typically a 0.75 in. distance between the inner run at rest and the head of the decay pattern modifier is sufficient Turning now to FIGS. 12–14, compound bows are commonly equipped with a hydraulic stabilizer intended to offset the degradation in accuracy attributable to the vibrations set up in the bow when an arrow is released.

Figure 12:
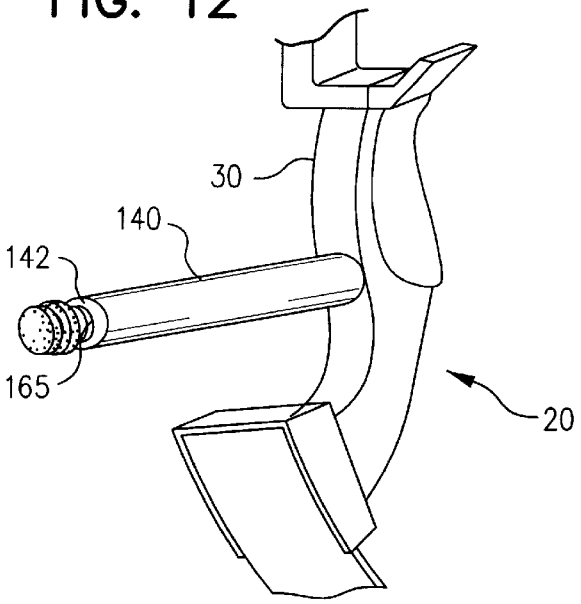
FIG. 12 is a fragmentary view of a bow equipped with: (1) a conventional, hydraulic type bow stabilizer, and (2) a stabilizer-associated accessory for modifying vibration decay patterns in accord with the principles of the present invention.

A stabilizer of the type in question will typically take the form of an elongated cylinder. A stabilizer of that type is depicted in FIG. 12 and identified by reference character 140. The stabilizer is mounted to, and extends forwardly from, the riser 30 of bow 20.

A significant increase in stability, attributable to a modification of vibration decay pattern, can be gained by assembling a decay pattern modifier of the type disclosed herein to the forward end 142 of stabilizer 140. A decay pattern modifier of the type depicted in FIGS. 2 and 3 can be employed or, alternatively, one may for example use a double headed decay pattern modifier of the type shown in detail in FIGS. 12 and 13 and identified by reference character 144. Decay pattern modifier 144 has two integral, disc-shaped heads 146 and 148 separated by an integral stem 150. A second, also integral stem 152 protrudes from the second head 148, and a threaded fitting (or decay pattern modifier mount) 154 is attached to the free end 156 of stem 152.

Figure 13:
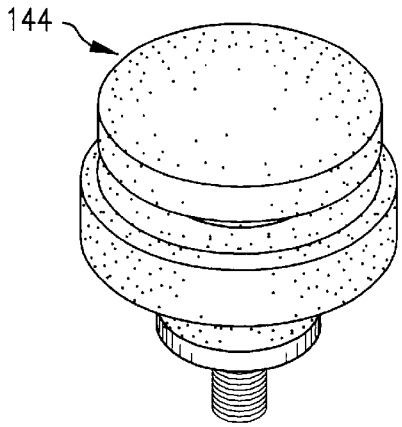
FIG. 13 is a perspective view of the decay pattern modifier illustrated in FIG. 12.

Decay pattern modifier 144 is fabricated from the same types of material as decay pattern modifier 24, and the decay pattern modifier is dimensioned so that stems 150 and 152 can oscillate in a 360° arc about the longitudinal axis 158 of decay pattern modifier 144 with the peripheral edges and of the two heads 146 and 148 of the decay pattern modifier being free to oscillate in 360° arcs generally parallel to axis 158 as indicated by the double headed arrows 160 and 162 in FIG. 13, and the decay pattern modifier otherwise being able to wiggle and jiggle in a manner effecting the beneficial decay pattern modification.

Decay pattern modifier 144 is assembled to the outer end 142 of stabilizer 140 by threading the stem 164 of damper mount 154 into a drilled and tapped, blind aperture 165 in the outer end of stabilizer 140—i.e., that end opposite the riser 30 of the bow.

Figure 15:
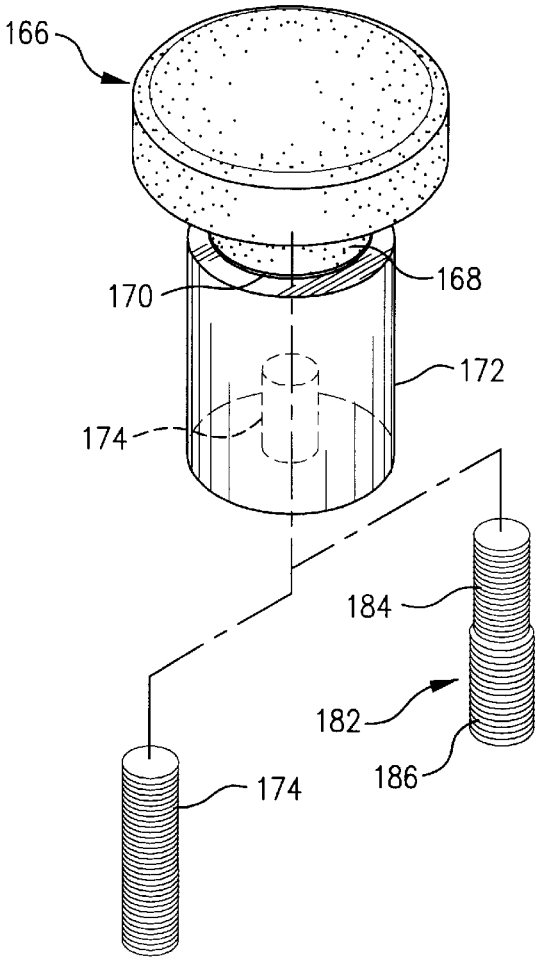
FIG. 15 is an imploded view of a second type of limb saver which embodies the principles of the present invention and is designed to be attached to a bow stabilizer.
Figure 16:
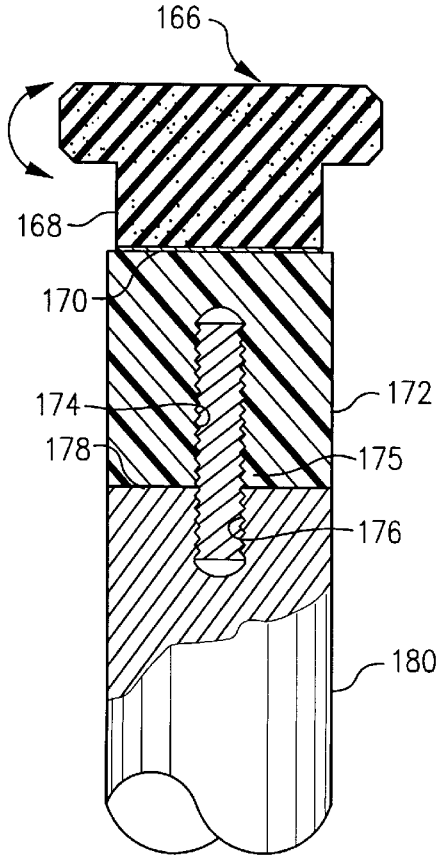
FIG. 16 is a section through the FIG. 15 decay pattern modifier and the outboard end of a bow stabilizer to which the accessory is attached.

FIGS. 15 and 16 show a variant 166 of the stabilizer-associated decay pattern modifier just described. The stem 168 of decay pattern modifier 166 is attached as by adhesive 170 to one end of a mount 172. This mount is formed from a polymer with sufficient rigidity that a blind aperture 174 can be drilled and tapped in the opposite end of the mount. A fastener threaded into aperture 174 and into a like aperture 176 in the end 178 of stabilizer 180 mounts decay pattern modifier 166 to the stabilizer.

As shown in FIG. 15, a second threader fastener 182 with two segments 184 and 186 may be supplied with vibration pattern modifier 166 in addition to, or in lieu of fastener 175. This makes the vibration pattern modifier usable with stabilizers having different diameters of accessory accepting recesses.

Figure 19:
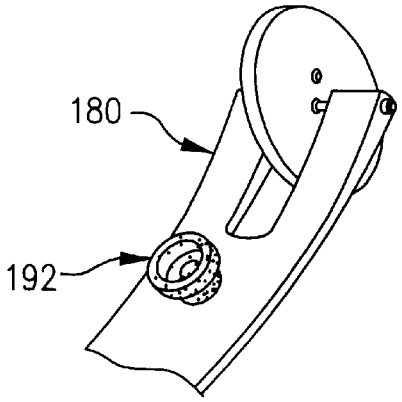
FIG. 19 is a fragmentary view, similar to FIG. 4, of a bow limb and yet another form of decay pattern modifier embodying the principles of the present invention.

Shown in FIG. 19 is the limb 180 of a split limb compound bow which may duplicate the bow 20 illustrated in FIG. 1. The bow is, in this case, equipped with yet another type of decay pattern modifier embodying the principles of the present invention. One of the two essentially identical vibration pattern modifiers with which the bow is equipped is identified in FIG. 19 by reference character 192.

Figure 20:
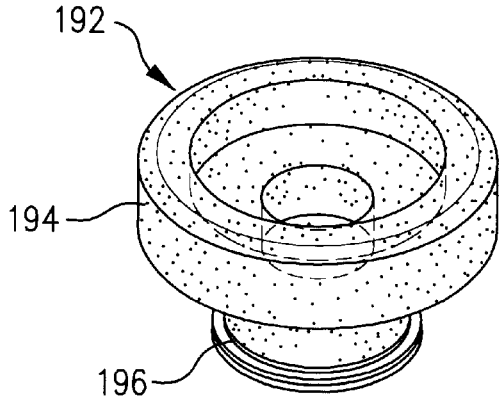
FIG. 20 is a perspective view of the FIG. 19 limb saver.
Figure 21:
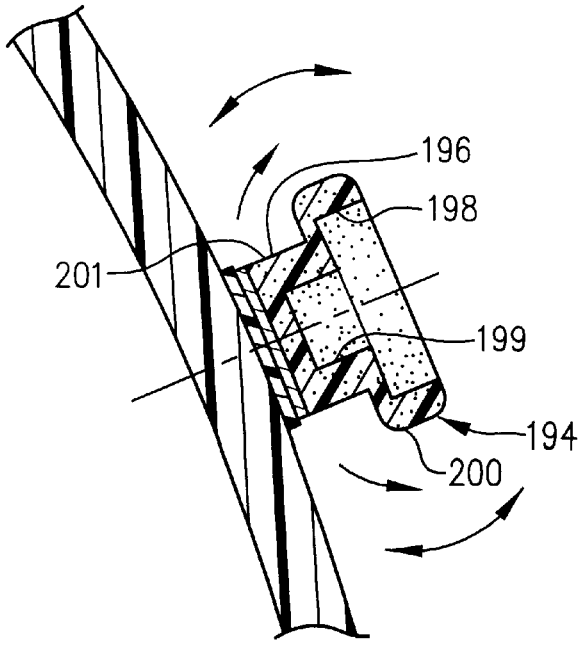
FIG. 21 is a section through the FIG. 20 decay pattern modifier.

Vibration pattern modifier 192, shown in more detail in FIGS. 20 and 21, has a head 194, an integral stem 196, and essentially the same overall dimensions as damper 22. Like the latter, vibration pattern modifier 192 is preferably, though not necessarily, fabricated from NAVCOM. Vibration pattern modifier 192 differs from its FIG. 2 counterpart primarily is that material is eliminated from head 194 and, to a considerable extent, from stem 196, leaving recesses 198 and 199 surrounded by walls 200 and 201 in the head and stem of the vibration pattern modifier.

Vibration pattern modifiers with a solid cross section—for example, those shown in FIGS. 2, 6, 8, and 10—have in some cases been found to be so effective in damping vibrations set up in a bow when an arrow is released as to overstress the bow limb, causing it to fail. Also, in some cases, the vibrations are damped so effectively that the vibration pattern modifier fails. The manner in which the vibrations are damped can be so modified as to avoid the just-discussed problems by "hollowing out" the decay pattern modifier as shown in FIGS. 20 and 21.

Vibration pattern modifier 192 is fastened to the bow limb 190 as by the illustrated adhesive 202 or in any other convenient manner.

It will be apparent to the reader that the invention may be embodied in many forms in addition to those disclosed herein without departing from the spirit or essential characteristics of the invention. The present embodiment is therefore to be considered in all respects as illustrative and not restrictive. The scope of the invention is indicated by the appended claims rather than by the foregoing description and the drawings, and all changes which come within the meaning and range of equivalency of the claims are therefore intended to be embraced therein.

What is claimed is:

1. In combination:

a bow which comprises a riser and limbs extending in opposite directions from opposite ends of said riser; and an elastomeric polymer a component operatively associated with each of said limbs for modifying the decay pattern of the vibrations set up in the limbs of said bow when an arrow is released.

2. A combination as defined in claim 1 in which the bow has solid limbs.

3. A combination as defined in claim 1 in which the bow has split limbs.

4. A combination as defined in claim 1 wherein the components associated with the limbs of the bow are alike.

5. In combination:

an archery bow;

a bow stabilizer; and a device for modifying the decay pattern of vibrations set up in said bow and said stabilizer when an arrow is released;

said bow comprising a raiser and limbs at opposite ends of said riser;

said stabilizer comprising an elongated member having first and second ends, the first end of the elongated member being fixed to the riser of the bow;

the decay pattern modifying device being fixed to the second end of said member; and said device comprising or being a member fabricated from an elastomeric material.

6. A device for modifying the decay pattern of the vibrations set up in an archery bow when an arrow is released, said device comprising:

a vibration pattern modifying component which has an integral head and stem and is fabricated from an elastomeric material; and a mechanism for attaching said component to a bow limb.

7. A device as defined in claim 6 in which the head and stem of the device are so configured and related that:

the head and stem of the device are free to wiggle and jiggle when an arrow is released and vibrations are consequently set up in the bow.

8. A device as defined in claim 6 in which the elastomeric material from which the decay pattern modifying components are fabricated comprises a mixture of chloroprene and butyl polymers.

9. A device as defined in claim 6 in which the component attachment mechanism comprises a layer of adhesive.

10. A device as defined in claim 6 in which the component attaching mechanism comprises:

a threaded fastener integrated with said component; and a complementary, internally threaded insert which is of sufficient rigidity to hold said fastener and is adapted to be installed in the limb of a bow with which the decay pattern modifying device is to be associated.

11. A device as defined in claim 6:

which is designed for a split limb bow; and has an attachment mechanism comprising a rigid mount which: (a) is fixed to an end of said stem, and (b) is dimensioned and configured to span a gap between branches of a split bow and to be fixed to said branches.

12. A device as defined in claim 11 in which the attachment mechanism comprises an adhesive for securing the mount to the branches of the split bow limb.

13. A device as defined in claim 6 in which the attachment mechanism comprises first and second clamp elements adapted to be seated on opposite sides of a split bow limb having two branches with a gap therebetween;

a threaded fastener so integrated with the first clamp element as to be extendible through a gap between two branches of a split bow limb; and a fitting integrated with the second clamp element into which the fastener can be threaded;

said vibration pattern modifying component being fixed to the second clamp component.

14. A decay pattern modifier for an archery bow stabilizer, said modifier comprising:

a first component which has an integral head and stem and is fabricated from an elastomeric material;

a second, internally threaded component which is affixed to the first component; and a fastener which is threadable into the second modifier component;

the second component of the decay pattern modifier being sufficiently rigid to retain the fastener in said second component of the decay pattern modifier.

15. A decay pattern modifier as defined in claim 14 in which the head and stem of the first modifier component are so related that the component can wiggle and jiggle when an arrow is released and thereby modify the decay pattern of vibrations set up in the component of the bow to which the decay pattern modifier is attached.

16. A decay pattern modifier as defined in claim 15 in which the head and stem of the first modifier component are so related that:

the stem of the first decay pattern modifier component can move in any and all directions in a 360° arc relative to a longitudinal axis of the modifier; and any and all peripheral portions of the head of the first decay pattern modifier component can oscillate toward and away from the stem of said first component.

17. A decay pattern modifier as defined in claim 14 in which the material from which said first component is fabricated comprises a mixture of chloroprene and butyl polymers.

18. A decay pattern modifier as defined in claim 11 which has an integral, annular element spaced along said stem from said head;

said annular element being free to wiggle and jiggle with said stem and said head.

19. In combination:

a bow which comprises a riser and limbs extending in opposite directions from opposite ends of said riser; and a component operatively associated with each of said limbs for modifying the decay pattern of the vibrations set up in the limbs of said bow when an arrow is released;

each decay pattern modifying component:

having a head and a stem integrated with said head; and being fabricated from an elastomeric material.

20. A combination as defined in claim 14 wherein:

the stem of each decay pattern modifying component is fixed at an exposed end to that limb of the bow with which it is associated; and the decay pattern modifying component is so capable of wiggling and jiggling as to effect said modification of vibration-decay pattern.

21. A combination as defined in claim 19 wherein each of the decay pattern modifying components comprises an adhesive on an exposed end of the component's stem for attaching the component to the associated bow limb.

22. A combination as defined in claim 19 wherein:

a rigid element is so fixed to an exposed end of the stem of each decay pattern modifying component to strengthen the union of said component to the associated bow limb.

23. A combination as defined in claim 22 in which each of the decay pattern modifying components has an adhesive on an exposed face of the rigid element.

24. A combination as defined in claim 19 wherein:

each decay pattern modifying component comprises an integral, threaded fastener; and there is a complementary threaded insert in the associated bow limb and extending through a gap between branches of said limb into which the fastener is threaded.

25. A combination as defined in claim 24 which comprises:

a first element fixing said one component to said bow limb segment; and a second element for fixing the decay pattern modifier to said second component.

26. A combination as defined in claim 19 in which:

each limb of the bow has a split limb segment comprising two parallel branches with a gap therebetween; and each decay pattern modifier comprises components for clamping the modifier to the split segment of the associated limb.

27. A combination as defined in claim 26 wherein the components for securing the modifier to the split limb segment of the associated bow limb comprise:

a first component which is fixed to an exposed end of the vibration decay pattern modifier stem and is seated on one side of the split limb segment;

a second, complementary component seated on the opposite side of the split limb segment; and a fastener arrangement for clamping the first and second branches of the split limb segment between said first and second components.

28. A combination as defined in claim 27 wherein said fastener arrangement comprises:

an internally threaded component integrated with said first component; and a complementary, externally threaded element integrated with said second component and threadingly engageable with the first internally threaded component.

29. A combination as defined in claim 19 in which the elastomeric material from which the decay pattern modifying components are fabricated comprises a visco-elasticmixture of chloroprene and butyl polymers.

30. A combination as defined in claim 19:

which includes a bow string; and wherein each of the bow limbs has an inner side facing the bow string and an outer side.

31. A combination as defined in claim 30 wherein each decay pattern modifying component is mounted to the outer side of the associated bow limb.

32. A combination as defined in claim 30 wherein;

each decay pattern modifying component is mounted to the inner side of the bow limb with which it is associated, and the component is so located along the associated bow limb as to space the head of the component sufficiently far from the bow string that said bow string does not interfere with the decay pattern modifying wiggling and jiggling of the component or knock the component off the bow limb when an arrow is released.

33. A combination as defined in claim 19:

which comprises a fastener for mounting each of the decay pattern modifying components to its associated bow limb, each said fastener having:

a head embedded in the stem of the associated decay pattern modifying component; and a shaft having an externally threaded segment protruding from said stem.

34. In combination:

an archery bow;

a bow stabilizer; and a device for modifying the decay pattern of vibrations set up in said bow and said stabilizer when an arrow is released;

said bow comprising a riser and limbs at opposite ends of said riser;

said stabilizer comprising an elongated member having first and second ends, the first end of the elongated member being fixed to the riser of the bow; and the decay pattern modifying device being fixed to the second end of said member;

the decay pattern modifying device having a stem and a head integral with said stem;

said device fabricated from an elastomeric material;

it being an end of said stem that is fixed to the stabilizer; and the device being free to wiggle and jiggle relative to the longitudinal axis of the device when an arrow is released and vibrations are consequentially set up in the stabilizer.

35. A combination as defined in claim 34 wherein:

the stem of the decay pattern modifying device has a first segment which is fabricated from said elastomeric material and is juxtaposed to the head of the component; and said device has a second segment which is fabricated from a more rigid material and is fixed to the first segment of the stem.

36. A combination as defined in claim 35 which compromises a fastener for attaching the decay pattern modifying device to the stabilizer member.

37. A combination as defined in claim 36 in which the fastener is threaded into the second segment of the decay pattern modifying device and has an exposed, externally threaded portion which can be threaded into a complementary, internally threaded recess in the second end of the bow stabilizer.

38. A combination as defined in claim 34 wherein there is an adhesive bond between the stem of the decay pattern modifying device and the second end of the stabilizer member.

* * * * *

UNITED STATES PATENT AND TRADEMARK OFFICE

CERTIFICATE OF CORRECTION

PATENT NO. : 6,298,842 B1
DATED : October 9, 2001
INVENTOR(S) : Steven C. Sims

It is certified that error appears in the above-identified patent and that said Letters Patent is hereby corrected as shown below:

Column 9,
Line 48, change "14" to -- 19 --.

Signed and Sealed this

Twenty-sixth Day of November, 2002

*Attest:*

*Attesting Officer*

JAMES E. ROGAN
*Director of the United States Patent and Trademark Office*

US006298842C1

(12) EX PARTE REEXAMINATION CERTIFICATE (5075th)

United States Patent

Sims

(10) Number: US 6,298,842 C1

(45) Certificate Issued: Mar. 1, 2005

(54) ARCHERY BOW ACCESSORIES WITH BOW VIBRATION DECAY PATTERN MODIFIERS FOR IMPROVING ACCURACY

(75) Inventor: Steven C. Sims, Shelton, WA (US)

(73) Assignee: Sims, Inc., Shelton, WA (US)

Reexamination Request:
No. 90/006,414, Oct. 15, 2002

Reexamination Certificate for:

| | |
|---|---|
| Patent No.: | **6,298,842** |
| Issued: | **Oct. 9, 2001** |
| Appl. No.: | **09/478,921** |
| Filed: | **Jan. 6, 2000** |

Certificate of Correction issued Nov. 26, 2002.

Related U.S. Application Data

(60) Provisional application No. 60/115,007, filed on Jan. 6, 1999.

(51) Int. Cl.[7] ..... F41B 5/20

(52) U.S. Cl. ..... 124/89; 267/136

(58) Field of Search ..... 124/89, 86, 23.1; 188/268; 267/136

(56) References Cited

U.S. PATENT DOCUMENTS

| | | | |
|---|---|---|---|
| 3,258,000 | A | 6/1966 | Kolpacki |
| 3,412,725 | A | 11/1968 | Hoyt, Jr. |
| 4,628,892 | A | 12/1986 | Windedahl et al. |
| 4,671,249 | A | 6/1987 | Troncoso |
| 4,811,947 | A | 3/1989 | Takatsuka et al. |
| 4,936,283 | A | 6/1990 | Izuta |
| 5,314,180 | A | 5/1994 | Yamagishi et al. |
| 5,341,792 | A | 8/1994 | Pucillo |
| 5,421,574 | A | 6/1995 | Yamagishi et al. |
| 5,772,541 | A | 6/1998 | Buiatti |

*Primary Examiner*—Kien Nguyen

(57) ABSTRACT

Devices for modifying the pattern of vibrations set up in a bow when an arrow is released. These devices have an integral head and stem and are fabricated from an elastomeric material. Versions suitable for attachment to bow with solid and split limbs are disclosed as are models designed for attachment to a bow stabilizer.

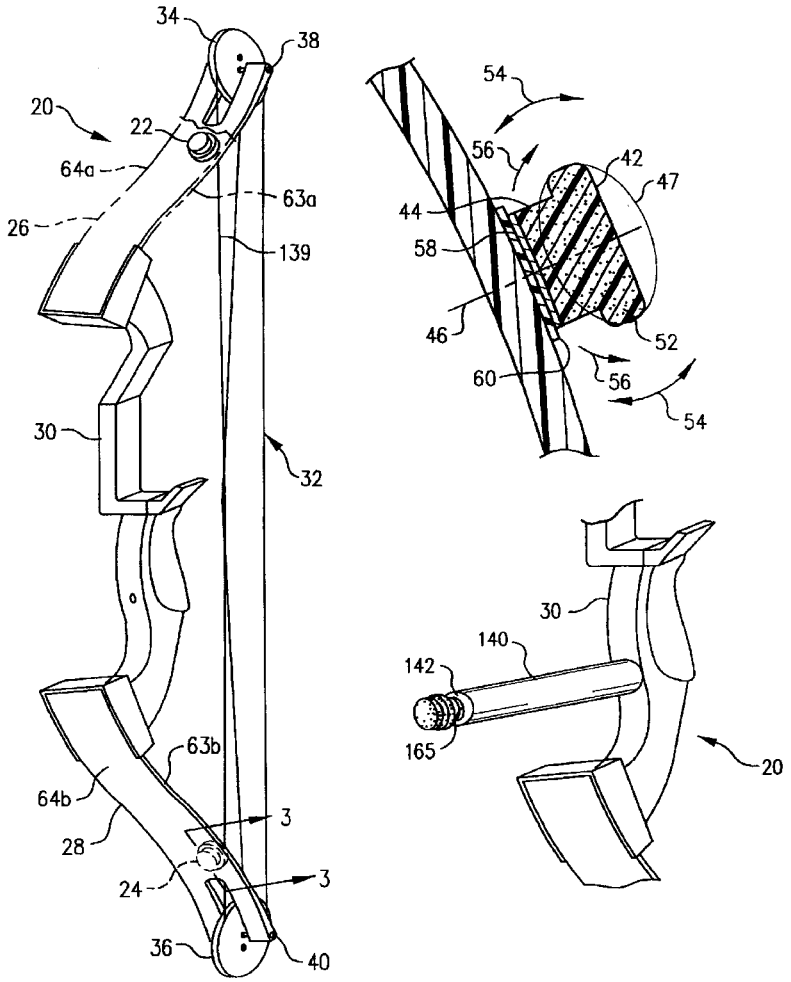

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–38 are cancelled.

New claims 39–49 are added and determined to be patentable.

*39. In combination:*

*an archery bow which comprises a riser and first and second limbs extending in opposite directions from opposite ends of said riser;*

*at least one pair of components for modifying the decay patterns of the vibrations set up in the bow limbs when an arrow is released; and*

*a component attachment mechanism mounting one of the pair of vibration decay pattern modifying components to each of the first and second bow limbs;*

*each of the vibration decay pattern modifying components being fabricated substantially in its entirety from a soft, elastomeric polymer material;*

*the vibration decay pattern modifying components being of similar configuration and construction;*

*each vibration decay pattern modifying component having a head and an integral stem axially aligned along a longitudinal axis of the component, said head being solely attached to said stem;*

*the head of the decay pattern modifying component having orthogonally related, spanwise dimensions which are substantially equal and edge portions protruding beyond the stem of the component; and*

*the component having a hardness, head and stem configurations, and relative head to stem dimensions so selected and effective that the head and stem of the decay pattern modifying component are capable of 360° vibration decay modifying patterns of movement relative to the longitudinal axis of the component upon release of an arrow from the bow.*

*40. A combination as defined in claim 39 wherein the hardness, head and stem configurations, and relative head to stem dimensions of the vibration decay pattern modifying component are so selected as to give the component the capability of wiggling and jiggling to modify the vibration decay pattern of the vibrations set up in the bow upon the release of an arrow from the bow.*

*41. A combination as defined in claim 39 where the elastomeric polymer material from which the vibration decay pattern modifying components are fabricated has a Shore A hardness in the range of 3–20.*

*42. A combination as defined in claim 39 wherein:*

*each of the bow limbs has first and second branches with a gap therebetween; and*

*each of the component attachment mechanisms comprises first and second clamp elements seated on opposite sides of a limb of the bow, the first and second clamp elements spanning the gap between the first and second bow limb branches;*

*a threaded fastener extending from the first clamp element through the first and second bow limb branches; and*

*internal threads in the second clamp element into which the fastener is threaded to draw the clamp elements together and clamp the bow limb therebetween;*

*one of the pair of vibration decay pattern modifying components being fixed to the second clamp element.*

*43. A combination as defined in claim 39 wherein the attachment mechanism comprises a layer of adhesive at the exposed end of the stem and a peel-off, protective layer overlying the adhesive.*

*44. In combination:*

*an archery bow which comprises a riser and first and second limbs extending in opposite directions from opposite ends;*

*at least one pair of components for modifying the decay patterns of the vibrations set up in the bow limbs when an arrow is released; and*

*a component attachment mechanism for mounting one of the pair of vibration decay pattern modifying components to each of the first and second bow limbs;*

*each of the vibration decay pattern modifying components being fabricated substantially in its entirety from a soft, elastomeric polymer material;*

*the vibration decay pattern modifying components being of similar configuration and construction;*

*each vibration decay pattern modifying component having a head and an integral stem axially aligned along a longitudinal axis of the component; and*

*there being a recess in the head of the vibration decay pattern modifying component which opens onto the exposed surface of the head and is surrounded by the material from which the vibration decay pattern modifying component is fabricated.*

*45. A combination as defined in claim 39 wherein the head of the decay pattern modifying component has orthogonally-related, spanwise dimensions which are substantially equal.*

*46. A combination as defined in claim 44 wherein the hardness, head and stem configuration, and relative head to stem dimensions of the vibration decay pattern modifying component are so selected as to give the component the capability of wiggling and jiggling to modify the vibration decay pattern of the vibrations set up in the bow upon the release of an arrow from the bow.*

*47. A combination as defined in claim 44 wherein the elastomeric polymer material from which the vibration decay pattern modifying components are fabricated has a Shore A hardness in the range of 3–20.*

*48. A combination as defined in claim 44 wherein:*

*each of the bow limbs has first and second branches with a gap therebetween; and*

*each of the component attachment mechanisms comprises first and second clamp elements seated on opposite sides of a limb of the bow, the first and second clamp elements spanning the gap between the first and second bow limb branches;*

*a threaded fastener extending from the first clamp element through the first and second bow limb branches; and*

*internal threads in the second clamp element into which the fastener is threaded to draw the clamp elements together and clamp the bow limb therebetween;*

*one of the pair of vibration decay pattern modifying components being fixed to the second clamp element.*

*49. A combination as defined in claim 44 wherein the attachment mechanism comprises a layer of adhesive at the exposed end of the stem and a peel-off, protective layer overlying the adhesive.*

* * * * *

US006298842C2

(12) EX PARTE REEXAMINATION CERTIFICATE (9664th)

United States Patent
Sims

(10) Number: US 6,298,842 C2
(45) Certificate Issued: May 16, 2013

(54) ARCHERY BOW ACCESSORIES WITH BOW VIBRATION DECAY PATTERN MODIFIERS FOR IMPROVING ACCURACY

(75) Inventor: Steven C. Sims, Shelton, WA (US)

(73) Assignee: Sims Vibration Laboratory, Inc., Shelton, WA (US)

Reexamination Request:
No. 90/009,930, Aug. 24, 2011

Reexamination Certificate for:

| | |
|---|---|
| Patent No.: | **6,298,842** |
| Issued: | **Oct. 9, 2001** |
| Appl. No.: | **09/478,921** |
| Filed: | **Jan. 6, 2000** |

Reexamination Certificate C1 6,298,842 issued Mar. 1, 2005

Certificate of Correction issued Nov. 26, 2002

Related U.S. Application Data

(60) Provisional application No. 60/115,007, filed on Jan. 6, 1999.

(51) Int. Cl.
*F41B 5/20* (2006.01)

(52) U.S. Cl.
USPC ..... 124/89; 267/136

(58) Field of Classification Search
None
See application file for complete search history.

(56) References Cited

To view the complete listing of prior art documents cited during the proceeding for Reexamination Control Number 90/009,930, please refer to the USPTO's public Patent Application Information Retrieval (PAIR) system under the Display References tab.

*Primary Examiner* — Jeffrey R Jastrzab

(57) ABSTRACT

Devices for modifying the pattern of vibrations set up in a bow when an arrow is released. These devices have an integral head and stem and are fabricated from an elastomeric material. Versions suitable for attachment to bow with solid and split limbs are disclosed as are models designed for attachment to a bow stabilizer.

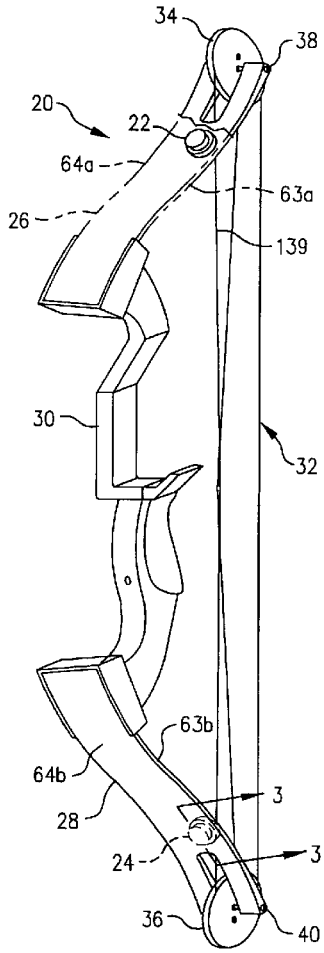

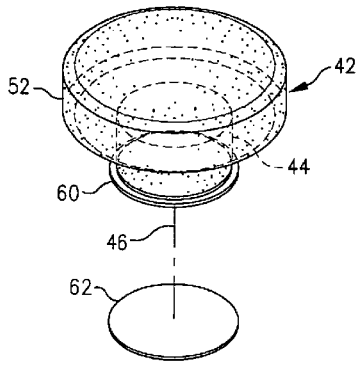

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-38 were previously cancelled.

Claims 39 and 44 are cancelled.

Claims 40-43 and 45-49 were not reexamined.

* * * * *